US009969055B2

(12) United States Patent
Groppe et al.

(10) Patent No.: US 9,969,055 B2
(45) Date of Patent: May 15, 2018

(54) METHOD AND DEVICE FOR SETTING A PREDETERMINED RADIAL GAP WIDTH FOR ROTOR BLADES OF A TURBOMACHINE

(71) Applicants: Rolf Groppe, Beverungen (DE); Michael Keller, Hohen Neuendorf (DE); Uwe Kirchhübel, Schleife (DE); Rolf-Dieter Woitscheck, Berlin (DE)

(72) Inventors: Rolf Groppe, Beverungen (DE); Michael Keller, Hohen Neuendorf (DE); Uwe Kirchhübel, Schleife (DE); Rolf-Dieter Woitscheck, Berlin (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 466 days.

(21) Appl. No.: 14/073,942

(22) Filed: Nov. 7, 2013

(65) Prior Publication Data

US 2014/0134926 A1 May 15, 2014

(30) Foreign Application Priority Data

Nov. 13, 2012 (EP) ..... 12192401

(51) Int. Cl.
*B24B 55/06* (2006.01)
*F01D 5/00* (2006.01)
(Continued)

(52) U.S. Cl.
CPC ..... *B24B 55/06* (2013.01); *B24B 19/14* (2013.01); *F01D 5/005* (2013.01); *F01D 5/20* (2013.01); *F01D 25/26* (2013.01)

(58) Field of Classification Search
CPC ..... B24B 19/14; B24B 21/165; B24B 55/05; B24B 55/052; B24B 55/06; B24B 55/10; B24B 55/102; F01D 5/005
(Continued)

(56) References Cited

U.S. PATENT DOCUMENTS 4,501,095 A 2/1985 Bires
4,726,104 A * 2/1988 Foster ..... B23K 35/224 228/118
(Continued)

FOREIGN PATENT DOCUMENTS

CN 1822920 A 8/2006
CN 201244777 Y 5/2009
(Continued)

*Primary Examiner* — Hadi Shakeri
*Assistant Examiner* — Marcel Dion

(57) ABSTRACT

A method and device for setting a predetermined radial gap width for rotor blades arranged in a housing of a turbomachine is provided. The method includes removing a housing part and at least partially exposing the rotor blades which are to be machined, arranging a grinding device in the region of a rotor blade which is to be machined such that the tip of the rotor blade is machined using a grinding disk of the grinding device, screening off the machining region by arranging a screening device which is formed so as to counter a release of grinding dust from the screen off machining region, providing a suction extraction such that it extracts grinding dust from the screened-off machining region and grinding the tip of the rotor blade in situ producing the radial gap width.

7 Claims, 3 Drawing Sheets

(51) Int. Cl.
*B24B 19/14* (2006.01)
*F01D 5/20* (2006.01)
*F01D 25/26* (2006.01)

(58) Field of Classification Search
USPC ..... 451/45, 451, 456
See application file for complete search history.

(56) References Cited

U.S. PATENT DOCUMENTS 4,905,421 A * 3/1990 Maier ..... B24B 55/102 451/359
5,704,826 A 1/1998 De Luis Vizcaino
5,813,118 A * 9/1998 Roedl ..... B23P 6/007 29/889.1
6,335,078 B2 * 1/2002 Venkataramani ..... 428/131
7,976,940 B2 * 7/2011 Berndt ..... C23C 8/04 427/375
2001/0007708 A1 7/2001 Venkataramani et al.
2003/0002945 A1 * 1/2003 Sunaga ..... B23K 11/3063 409/140
2006/0168809 A1 * 8/2006 McCarvill ..... B23P 6/002 29/889.1
2008/0005904 A1 * 1/2008 Orobengoa Ortubay ..... B24B 19/14 29/889.23
2012/0119633 A1 * 5/2012 McCarvill ..... F01D 25/24 312/237
2012/0207586 A1 * 8/2012 Chehab ..... F01D 11/122 415/118
2013/0005226 A1 * 1/2013 Watanabe ..... B29D 30/54 451/451
2013/0178134 A1 * 7/2013 Eriksen ..... B24B 19/14 451/6

FOREIGN PATENT DOCUMENTS

CN 101631646 A 1/2010
CN 102741042 A 10/2012
DE 29804858 U1 7/1998
DE 19908708 A1 3/2000
DE 102008037429 A1 4/2009
GB 2270485 A * 3/1994 ..... B24B 19/14
JP WO 2011096141 A1 * 8/2011 ..... B29D 30/54

* cited by examiner

METHOD AND DEVICE FOR SETTING A PREDETERMINED RADIAL GAP WIDTH FOR ROTOR BLADES OF A TURBOMACHINE

CROSS REFERENCE TO RELATED APPLICATIONS

The present application claims priority to European Patent Office application No. 12192401.3 EP filed Nov. 13, 2012, the entire content of which is hereby incorporated herein by reference.

FIELD OF INVENTION

The present invention relates to a method for setting a predetermined radial gap width for rotor blades arranged in a housing of a turbomachine.

BACKGROUND OF INVENTION

Blades of turbomachines, in particular turbine blades, are exposed to very high material loading and correspondingly high wear during operation. For this reason, in the context of maintenance work, the blades are normally replaced with new blades after a predetermined operating time. The operating time is advantageously chosen such that the blades which have been removed can still be repaired.

Replacing the blades of a turbine involves replacing the turbine rotor blades, the turbine guide vanes and the guide segments. In order to be able to ensure that the original turbine performance is maintained in the event of such a replacement, it is necessary that the new turbine rotor blades still have the original radial blade gap width. To that end, the tips of the new rotor blades are correspondingly machined before their assembly. However, since the radial gap width depends not only on the production tolerances of the new rotor blades but also on further influencing factors, the final radial blade gap results only once all the blades have been completely replaced. Influencing factors are in this case for example the profile of the new guide vanes, the profile of the new guide rings, the coating of the new guide vanes and guide rings, the difference in the position of the new blades with respect to that of the replaced old blades, and similar considerations. Calculating the final gap width in advance is correspondingly difficult and can only be done within a very broad tolerance margin.

The machining of the tips of new rotor blades in order to set the radial gap width is normally performed by grinding. This is always performed away from the turbomachine since otherwise there would be the risk of the turbomachine being impaired by the grinding dust produced during the machining process. The blades can thus be machined when mounted on the original rotor disk, for example using a conventional grinding system, although this requires the rotor to be unstacked beforehand, which involves a considerable amount of effort. As an alternative, instead of the original rotor disk, what is termed a dummy rotor disk can be used, whereby the rotor need not be unstacked. However, using such a dummy rotor disk also implies decreased machining accuracy, which can have a negative effect on the performance of the turbomachine. There is further the possibility of machining the rotor blades without a rotor disk, using what is termed a single blade grinding apparatus, which entails further penalties with respect to machining accuracy.

SUMMARY OF INVENTION

Proceeding from this prior art, it is an object of the present invention to provide a method of the type mentioned in the introduction and a grinding device for carrying out the method, by means of which setting a predetermined radial gap width for rotor blades arranged in a housing of a turbomachine, in the context of machining the blade tips by grinding, can be performed simply, quickly and conveniently while ensuring very high machining accuracy, without endangering the proper operation of the turbomachine.

In order to achieve this object, the present invention provides a method of the type mentioned in the introduction, comprising the following steps: a) removing a housing part, at least partially exposing the rotor blades which are to be machined; b) arranging a grinding device in the region of a rotor blade to be machined such that the tip of the rotor blade can be machined using a grinding disk of the grinding device; c) screening off the machining region by arranging a screening device which is formed so as to counter a release of grinding dust from the screened-off machining region; d) providing a suction extraction such that it extracts grinding dust from the screened-off machining region; and e) grinding the tip of the rotor blade in situ, producing the predetermined radial gap width. The method according to the invention is notable in particular in that the screening off of the machining region and the use of suction extraction prevent the turbomachine from being contaminated with grinding dust, making it possible to machine in situ a rotor blade in the normal mounted state. Machining the rotor blades in situ is advantageous on one hand in that a very high machining accuracy—superior to the known methods—is achieved, such that not only can it be ensured that an original performance of the turbomachine is retained, but also the performance can be optimized by setting the radial gap width. On the other hand, in order to carry out the method, it is not necessary to unstack the rotor, resulting in time and cost savings. The rotor blades can for example be compressor or turbine rotor blades.

Preferably, upon completion of step e), the grinding device and a further rotor blade are oriented toward each other, whereupon steps c) to e) are repeated. In other words, multiple rotor blades are in this case machined one after the other.

In accordance with one variant of the method according to the invention, step e) is carried out on a rotor blade whose tip is already pre-ground. Pre-grinding the blade tip can for example be performed in a state where the rotor blade is attached to a dummy rotor disk as described in the introduction, or using a single blade grinding device. The final or fine machining is then performed with the blade in the normal mounted state using the method according to the invention, whereby very high machining accuracies and correspondingly optimal performance of the turbomachine can be achieved.

The screening device is preferably formed by a brush arrangement which is provided on the grinding device and encloses the grinding disk in annular fashion. Using a brush arrangement as a screening device is moreover advantageous in that the flexible brushes rest in a sealing manner against the component to be machined, thus eliminating gaps through which grinding dust can escape from the screened-off machining region.

The dimensions of the grinding device used are advantageously adapted to the separations between axially adjacent bladings of the turbomachine, such that the rotor blades of all bladings can be machined using the grinding disk of the grinding device without there being any collision. It is accordingly possible for example to machine the rotor blades of all the stages of a turbine using a single grinding device, thus avoiding change-over times.

Cooling fluid bores provided on the rotor blade are preferably at least partially closed off before step e) is carried out. This makes it possible to prevent grinding dust produced during the machining from clogging cooling fluid bores located inside the screened-off machining region. This also counters a blocking of the cooling fluid bores should grinding dust be released from the screened-off machining region in spite of the screening device and the suction extraction.

Cooling air bores are advantageously closed off using adhesive tape and/or wax. Adhesive tape is preferred at those locations which do not come into contact with the screening device. The use of wax is of particular advantage in the region of the blade tips since wax does not normally come away on contact with the screening device.

According to one configuration of the method according to the invention, the grinding device is held on a compound slide arranged on a base plate so as to be movable in two mutually perpendicular directions. Accordingly, the grinding disk can be moved in a suitable manner for machining the blade tip.

In step b) the base plate is preferably fastened to the housing of the turbomachine. Accordingly, undesired relative movements between the grinding disk and the rotor blade to be machined can be prevented, and thus a proper work result can be guaranteed.

In order to achieve the object mentioned in the introduction, the present invention further provides a grinding device, in particular for carrying out the method described above, comprising a grinding disk, a screening device which encloses the grinding disk and is formed such that it screens off the machining region during the proper operation of the grinding device, and a suction extraction which is formed such that it extracts grinding particles from the screened-off machining region during the proper operation of the grinding device.

According to one configuration of the grinding device according to the invention, the screening device is provided in the form of a brush arrangement which encloses the grinding disk in annular fashion. Very good results have been achieved with a brush arrangement of this type.

The grinding device is preferably held on a compound slide arranged on a base plate so as to be movable in two mutually perpendicular directions.

A fastening device is advantageously provided on the base plate, which fastening device is formed such that the base plate can be releasably fastened to a housing of a turbomachine.

BRIEF DESCRIPTION OF THE DRAWINGS

Further features and advantages of the present invention will become clear upon reading the description which follows of an exemplary embodiment, with reference to the appended drawing, in which.

DETAILED DESCRIPTION OF INVENTION

Figure 1:
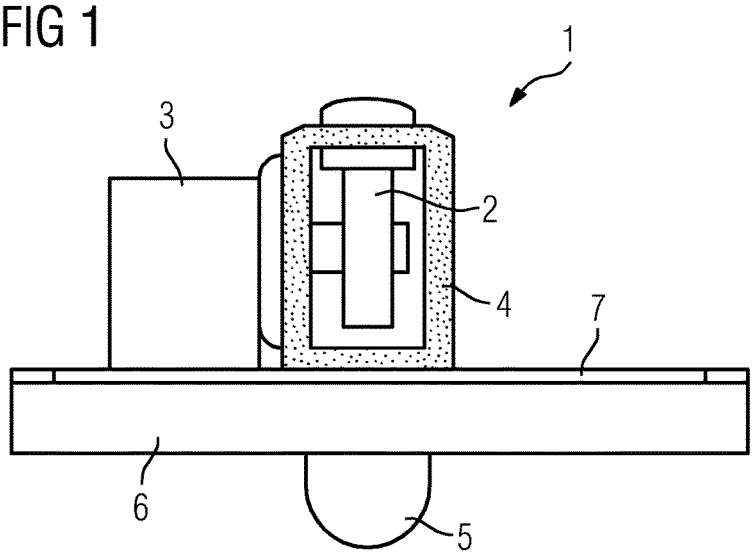
FIG. 1 is a schematic front view of a grinding device according to one embodiment of the present invention.

FIG. 1 shows a grinding device 1 according to one embodiment of the present invention. The grinding device 1 comprises a grinding disk 2, which is driven in rotation via a drive 3. The grinding disk 2 is enclosed in annular fashion by a screening device, which in the present case is formed by a brush arrangement 4. The brush arrangement 4 comprises a multiplicity of flexible bristles, which project outward beyond the grinding disk 2 such that, during the proper operation of the grinding device 1, they come into contact with a workpiece to be machined. The grinding device 1 further comprises, arranged below the grinding disk 2, a suction extraction 5 which, during the proper operation of the grinding device 1, extracts grinding particles from the screened-off machining region of the grinding device 1, which region is defined by the brush arrangement 4. The drive for the grinding disk 2 is coupled to the suction extraction 5 such that the drive is automatically switched off should the suction extraction 5 fail. The grinding device 1 is held on a compound slide 7 arranged on a base plate 6 so as to be movable in two mutually perpendicular directions in the plane of the base plate 6. The grinding device 1 is moved by means of a drive unit (not illustrated in more detail) and an assigned control unit. The dimensions and the weight of the grinding device 1 are together chosen such that the device can be easily packed and transported to the location where turbomachines are in operation. The grinding device 1 is preferably embodied as a portable unit.

Figure 2:
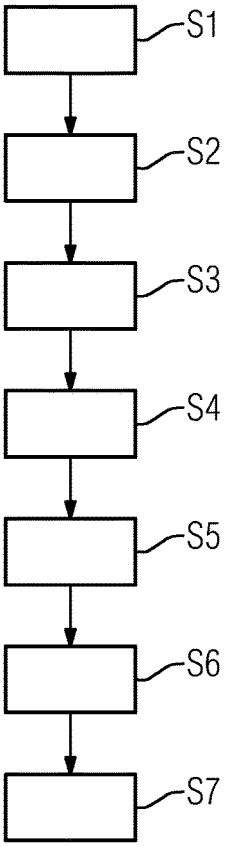
FIG. 2 is a flow chart schematically showing the steps of a method, carried out using the grinding device depicted in FIG. 1, according to one embodiment of the present invention.

FIG. 2 shows a flow chart of a method, according to one embodiment of the present invention, which is carried out using the grinding device 1 depicted in FIG. 1. The method serves to optimize a predetermined radial gap width of rotor blades arranged in a housing of a turbomachine, and accordingly to optimize the performance of the turbomachine.

Figure 3:
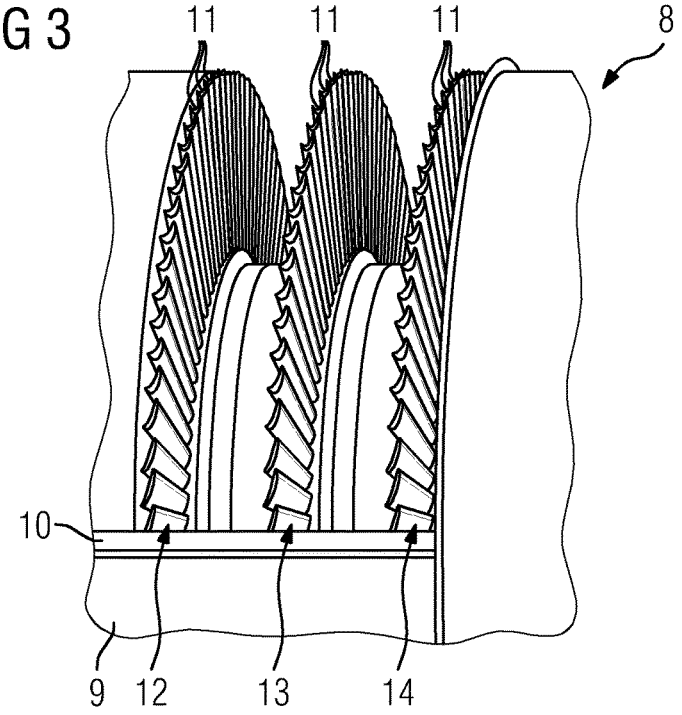
FIG. 3 is a schematic perspective view of part of a turbomachine, showing three axially adjacent rotor bladings, or stages, with the upper housing part removed.

The starting point for this method variant according to the invention is a turbomachine whose radial gap width and/or performance has already been set using one of the known methods described in the introduction, by shortening the rotor blades. On account of the fact that, in all these methods, the rotor blades are machined when uninstalled, setting the radial gap width and accordingly the performance of the turbomachine can be optimized further, to which end, according to the invention, the following steps are carried out:

In a first step S1, a housing part of the turbomachine is removed, at least partially exposing rotor blades to be machined. FIG. 3 shows, as an example, a view of part of a turbomachine 8 after step S1 has been carried out. The turbomachine 8 comprises a two-part housing having a lower housing shell 9 and an upper housing shell, which is positioned on top of the lower housing shell 9 and, in the normal state, is securely screwed thereto along a joint 10. In the state depicted in FIG. 3, the upper housing shell has been lifted off such that the rotor blades 11 of the present turbomachine having three stages 12, 13 and 14 are freely accessible.

In a second step S2, cooling fluid bores of the individual rotor blades 11 are closed off using adhesive tape 15 and/or wax in order to prevent grinding dust from being able to clog the cooling fluid bores while a subsequent grinding machining is carried out in step S6. Adhesive tape 15 is used at those locations which do not come into contact with the brush arrangement 4 in the context of the grinding machining. By contrast, at all other locations, especially in the region of the blade tips, wax is used, since it does not come away even on contact with the brush arrangement 4.

Figure 4:
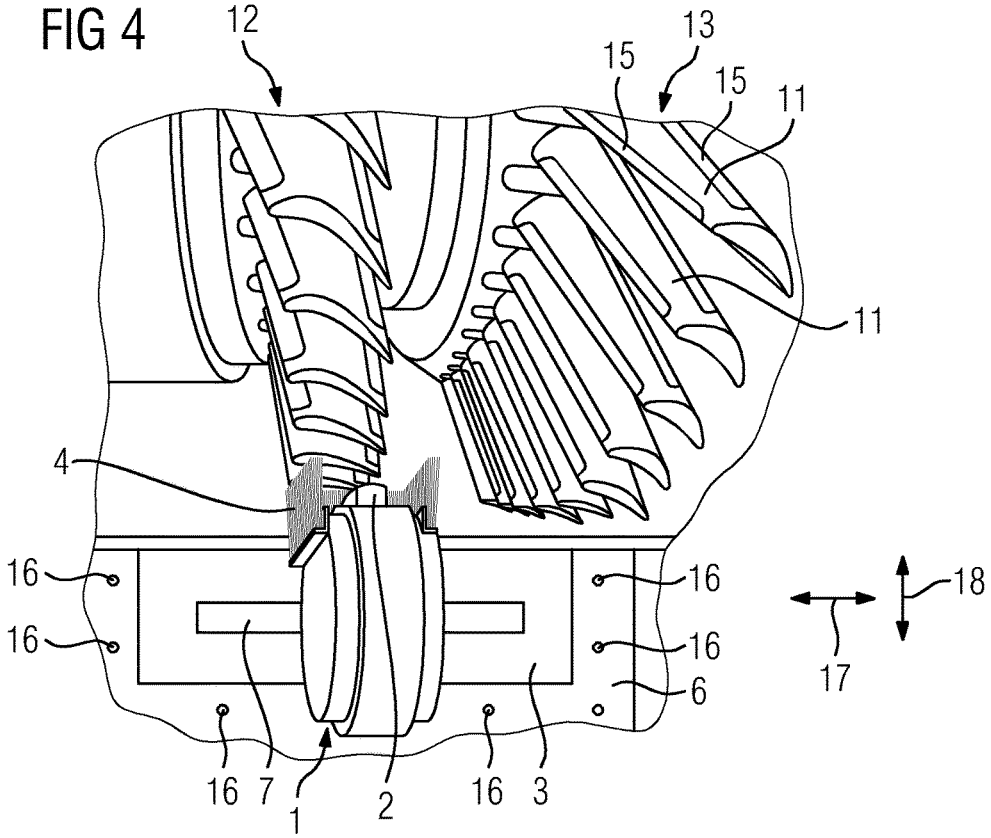
FIG. 4 is an enlarged schematic perspective view of the part of the turbomachine depicted in FIG. 3, showing the machining of the tip of a rotor blade of the turbomachine using the grinding device depicted in FIG. 1.

In step S3, the grinding device 1 is arranged in the region of a rotor blade 11 to be machined—belonging to stage 12—such that the tip of the rotor blade can be machined using the grinding disk 2 of the grinding device 1. More specifically, the base plate 6, on which the grinding device 1 is mounted, is fastened at the joint 10 of the lower housing shell 9 of the turbomachine 8 by means of screws 16, as schematically depicted in FIG. 4. Accordingly, the grinding disk 2 can be moved in the direction of the arrows 17 and 18 by means of the compound slide 7 in order to machine the rotor blade 11.

As soon as the grinding disk 2 is brought, in the direction of the arrow 18, up to the tip of a rotor blade 11 to be machined, the brushes of the brush arrangement 4 come into sealing contact with the rotor blade 11, whereby in accordance with step S4 the machining region is screened off such that, during the grinding machining, a release of grinding dust from the screened-off machining region is countered. It should be noted that the upper row of brushes of the brush arrangement 4 is not shown in FIG. 4 such that the grinding disk 2 is visible.

When the grinding disk 2 is brought up to the rotor blade 11, the suction extraction 5 is also automatically provided, according to step S5, such that during the grinding machining it extracts grinding dust from the screened-off machining region.

In a further step S6, the tip of the rotor blade 11 is then ground in situ, creating the predetermined optimized gap width. Very high machining accuracies are achieved by virtue of the fact that the rotor blade 11 is machined by grinding when properly mounted. During the machining process, the brush arrangement 4 prevents the grinding dust from being released from the screened-off machining region, and the suction extraction 5 removes this dust from the machining region. Contamination of the turbomachine by grinding dust is thus effectively countered. Were the suction extraction 5 to fail during the grinding machining, the drive for the grinding disk 2 would automatically be shut off since, without suction extraction, it would no longer be possible to guarantee contamination-free machining.

In a further step S7, the stage 12 is rotated such that the tip of a further rotor blade 11 can be machined using the grinding disk 2 of the grinding device 1, whereupon steps S4 to S6 are repeated. This procedure is repeated until all the rotor blades 11 of the stage 12 have been machined so as to optimize the gap width.

In order to machine a rotor blade 11 of the adjacent stage 13, the grinding disk 2 can be moved in the direction of the arrow 17 to the stage 13, depending on the breadth of the base plate 6 or on the length of the compound slide 7. As an alternative, the base plate 6 can of course also be displaced manually along the joint 10 of the turbomachine 8.

The dimensions of the grinding device 1 are adapted to the separations between the individual stages 12, 13 and 14 such that the rotor blades 11 of all stages 12, 13 and 14 can be machined using the grinding disk 2 of the grinding device 1 without there being any collision. In other words, the breadth of the grinding device 1 is chosen such that, when machining a rotor blade 11 of the stage 12, there is no risk of the grinding device 1 colliding with the rotor blades 11 of the stage 13 which project radially beyond the rotor blades 11 of the stage 12. It is also possible to machine the rotor blades 11 of the stage 13 without the grinding device 1 colliding with the rotor blades 11 of the stage 14.

Figure 5:
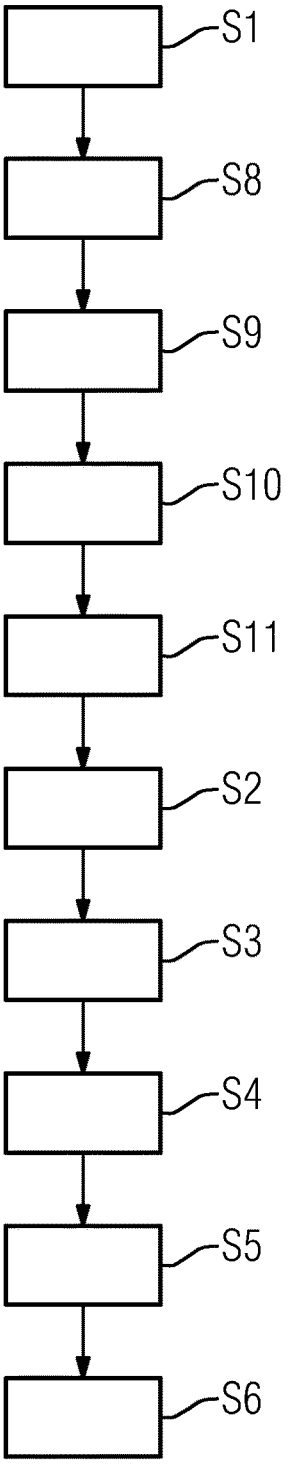
FIG. 5 is a flow chart schematically showing the steps of a method, carried out using the grinding device depicted in FIG. 1, according to a further embodiment of the present invention.

FIG. 5 shows a flow chart for a method, according to a further embodiment of the present invention, whereby, after worn rotor blades have been replaced with new rotor blades, the original gap width can once again be set. For the sake of simplicity, method steps of this second variant which correspond to method steps of the first method variant described with reference to FIG. 2 are provided with identical reference signs in FIG. 5. An explanation of these mutually corresponding method steps will not be repeated below.

In step S1, a housing part of a turbomachine is removed, at least partially exposing rotor blades of the turbomachine to be machined, such that for example an arrangement according to FIG. 3 results.

In a subsequent step S8, rotor blades to be replaced are removed.

New rotor blades, which replace the worn rotor blades, are provided in a further step S9.

In step S10, the tips of the new rotor blades provided in step S9 are pre-machined by grinding. This pre-machining can for example be performed using a dummy rotor disk or a single blade grinding device, as described in the introduction in connection with the methods known in the prior art.

In step S11, the pre-machined rotor blades are installed as replacements for the rotor blades removed in step S8.

Steps S2, S3, S4, S5 and S6, already described above, are then performed in order to shorten the pre-machined rotor blades, by machining the tips thereof by grinding in order to restore or optimize the predetermined radial gap width, and thus give them their final dimensions.

The new rotor blades are pre-machined in the uninstalled state in step S10, first and foremost because the amount of grinding dust produced in step S6 should be reduced to a minimum. The less grinding dust is produced in step S6, the lower the risk of the turbomachine being contaminated during the grinding machining process. Thus, only a fine machining is carried out in step S6.

It should however be noted that, according to the present invention, step S10 can be dispensed with entirely and the grinding machining of the rotor blade tips can be performed entirely in step S6.

Although the invention has been illustrated and described in detail by means of the embodiments, the invention is not limited by the disclosed examples and other variations can be derived herefrom by a person skilled in the art without departing from the protective scope of the invention.

We claim:

1. A method for setting a predetermined radial gap width for rotor blades arranged in a housing of a turbomachine, the method comprising:

removing a half of a housing shell, at least partially exposing the rotor blades which are to be machined;

arranging a grinding device in a region of a rotor blade which is to be machined such that a tip of the rotor blade is machined using a grinding disk of the grinding device;

screening off the machining region by arranging a screening device which is formed so as to counter a release of grinding dust from the screened-off machining region;

providing a suction extraction such that it extracts grinding dust from the screened-off machining region; and grinding the tip of the rotor blade in situ, within the turbomachine in a normal mounted state producing the predetermined radial gap width, wherein the screening device is formed by a brush arrangement coming into a sealing contact with the rotor blade and which is provided on the grinding device and encloses the grinding disk in annular fashion, wherein the grinding device is held on a compound slide arranged on a base plate so as to be movable in two mutually perpendicular directions, and wherein in the arranging the base plate is fastened to the housing of the turbomachine.

2. The method as claimed in claim 1, wherein, upon completion of the grinding, the grinding device and a further rotor blade are oriented toward each other, and wherein the screening off and the providing are repeated.

3. The method as claimed in claim 1, wherein the grinding is carried out on a rotor blade whose tip is already pre-ground.

4. The method as claimed in claim 1, wherein a dimension of the grinding device used is adapted to a separation between axially adjacent bladings of the turbomachine, such that the rotor blades of all bladings are machined using the grinding disk of the grinding device without there being any collision.

5. The method as claimed in claim 1, wherein cooling fluid bores provided on the rotor blade are at least partially closed off before the grinding is carried out.

6. The method as claimed in claim 5, wherein cooling air bores are closed off using adhesive tape and wax.

7. The method as claimed in claim 5, wherein cooling air bores are closed off using adhesive tape or wax.

* * * * *